US005375762A

United States Patent [19]

Jacobs

[11] Patent Number: 5,375,762

[45] Date of Patent: Dec. 27, 1994

[54] CONTAINER TRAY

[75] Inventor: James D. Jacobs, Lake Carroll, Ill.

[73] Assignee: Honeywell, Inc., Minneapolis, Minn.

[21] Appl. No.: 186,206

[22] Filed: Jan. 25, 1994

[51] Int. Cl.[5] ..... B65D 5/48

[52] U.S. Cl. ..... 229/120.24; 229/112; 229/120.32; 229/120.34; 229/177

[58] Field of Search ..... 229/120.14, 120.32, 229/120.33, 120.34, 112, 177, 178

[56] References Cited

U.S. PATENT DOCUMENTS

| | | | |
|---|---|---|---|
| 549,783 | 11/1895 | Guilbert | 229/120.34 |
| 588,423 | 8/1897 | Guilbert | 229/120.34 |
| 2,606,710 | 8/1952 | Reaves | 229/120.34 |
| 3,728,002 | 4/1973 | Zacks | 229/178 |
| 3,749,299 | 7/1973 | Ingle | 229/120.34 |
| 4,469,272 | 9/1984 | McFadden et al. | 229/112 |
| 4,579,220 | 4/1986 | Brundage | 229/178 |
| 4,770,339 | 9/1988 | Weimer | 229/178 |
| 4,938,415 | 7/1990 | Walker et al. | 229/178 |
| 5,143,431 | 9/1992 | Udell | 229/120.24 |

FOREIGN PATENT DOCUMENTS

| | | | |
|---|---|---|---|
| 273799 | 8/1969 | Austria | 229/120.34 |
| 2020617 | 1/1992 | Canada | 229/120.34 |
| 899431 | 6/1962 | United Kingdom | 229/120.34 |

*Primary Examiner*—Gary E. Elkins
*Attorney, Agent, or Firm*—William D. Lanyi

[57] ABSTRACT

A container tray is provided with a tray member and an insert member that are able to be assembled in conjunction with each other. The tray member is shaped to provide a series of extension members, tabs and notches that form end portions of the tray member that lock the side panels together in a robust manner. The extension members, notches, slots and tabs are also arranged to facilitate the assembly of a flat paper structure into a strong tray member. The insert member is provided with a plurality of risers and notches that are shaped to be received by associated components in the tray member and lock the insert member rigidly into place within the tray member. The container tray can be used during the assembly and testing process of components and can also be used to shipped the finished components to a customer without having to remove the product from one tray and place it into another shipping container. The structure of the container tray permits it to be manufactured from materials that are not environmentally harmful.

14 Claims, 6 Drawing Sheets

CONTAINER TRAY

BACKGROUND OF THE INVENTION

1. Field of the Invention

The present invention is generally related to a container tray and, more specifically, to a container tray that comprises two one-piece members that are associated together to provide a robust container that is both easy to assemble and usable both for carrying components during the manufacturing process and when the finished products are shipped to a customer.

2. Description of the Prior Art

When relatively small components, such as switches or sensors, are manufactured, it is well known to provide a reusable tray for the purpose of containing the components during their assembly process and during testing procedures. It is also well known to use shipping containers for the purpose of transporting the finished products from the place of manufacture to the customer of the finished product. It is typical to use containers, such as stainless steel trays, to move the unfinished components from one work station to another in a manufacturing facility. It is also typical to remove the finished components from the tray and repackage them in paper or corrugated paperboard containers for the purpose of shipping the finished products to a customer.

Several disadvantages are inherent in these known methods for transporting products through the manufacturing and testing processes and eventually to a customer. First, when reusable trays are used during the manufacturing and testing process, they often must be cleaned after use prior to their reuse. In addition, the removal of finished products from the reusable trays to transfer them into packing boxes requires an additional operation that is time consuming and increases the cost of the products. Perhaps the most disadvantageous characteristic of the known methods described above is that many shipping containers use materials that can be environmentally harmful. For example, when expanded polystyrene (EPS) shipping containers are used, because of their light weight and strength, disposal of the shipping trays can be environmentally unsound because of the potentially inefficient use of landfills that could result. In addition, the manufacture of polystyrene requires the use of petroleum which is a nonrenewable resource. It would therefore be significantly beneficial if a means could be used to provide an easily recyclable container tray that can be used both during the manufacturing process and then for shipping the finished products to the customer.

SUMMARY OF THE INVENTION

The present invention provides a container tray that avoids the disadvantages described above. The container tray of the present invention can be used during the assembly process when products are moved from one work station to another work station and then tested prior to shipment. The same container tray of the present invention can also be used to ship the products to customers. Therefore, the present invention avoids the need to clean container trays which are used within the manufacturing facility and then unload those trays when the products are repackaged into their shipping containers. Since the present invention made from corrugated paperboard, which is easily recyclable and is made from a renewable resource, and is also sufficiently robust to can withstand the rigors of shipment, it avoids the need for using expanded polystyrene or other materials which can be harmful to the environment. The particular structure of the present invention also facilitates the assembly of the container trays prior to their use in the manufacturing process.

In a preferred embodiment of the present invention, a tray member is provided with a first planar surface. First and second side panels are connected to the first planar surface at first and second bend lines, respectively. The first planar surface is disposed between the first and second side panels which are attached to opposite sides of the first planar surface. A first extension member is connected to the first side panel at a third bend line and a second extension member is connected to the second side panel at a fourth bend line.

A third extension member is connected to the first planar surface at a fifth bend line. The third extension member comprises a first portion and a second portion. The second portion is connected to the first portion at a sixth bend line and the first portion is connected to the planar surface at the fifth bend line. A first tab and a second tab extend in a common direction from the second portion of the third extension member. The second portion of the third extension member is disposed between the first and second tabs and the sixth bend line.

A first slot and a second slot extend through the tray member at the fifth bend line. First and second notches are formed in the first and second extension members, respectively. A third notch is formed in the second portion of the third extension.

The first side panel is bendable at the first bend line into generally perpendicular association with the first planar surface and the second side panel is bendable at the second bend line into generally perpendicular association with the first planar surface. The first extension member and the second extension member are then bendable at the third and fourth bend lines, respectively, into overlapping association with each other. The third extension member is bendable at the fifth bend line into generally perpendicular association with the first planar surface. Although the third extension member is described as being bendable into generally perpendicular association with the first planar surface, a particularly preferred embodiment of the present invention alters the perpendicularity to a slight degree for an advantageous purpose which will be described in greater detail below.

The second portion of the third extension member is bendable at the sixth bend line into overlapping association with the first portion of the third extension member. When the first and second portions of the third extension member are bent in the manner described immediately above, the first and second extension members are disposed between them. When this assembly procedure is accomplished, the first and second notches are aligned with each other. The first slot is shaped to receive the first tab therein and the second slot is shaped to receive the second tab therein.

A particularly preferred embodiment of the present invention also comprises an insert member which has a second planar surface. A first riser extends in generally perpendicular association from the second planar surface and is formed by bending the insert member along seventh, eighth and ninth bend lines. The first notch, second notch and third notch are shaped to receive an end of both the first riser therein.

A fourth notch is formed in the second planar surface and is shaped to receive the first tab therein. A fifth notch is formed in the second planar surface and is shaped to receive the second tab therein. The insert member is disposable within the tray member with the first planar surface being disposed in generally parallel association with the second planar surface.

In a preferred embodiment of the present invention, the container tray also comprises a third slot that extends through the sixth bend line and a third tab that extends from the first extension member. A fourth tab extends from the second extension member with the first and fourth tabs being disposable in overlapping association with each other when the first and second extension members are disposed in overlapping association with each other. The third slot is shaped to receive the third and fourth tabs therein.

In a particularly preferred embodiment of the present invention, the third and fourth bend lines are disposed in nonaligned association with the fifth bend line. This nonaligned association displaces the third and fourth bend lines at approximately a three degree angle from the fifth bend line. This slight amount of nonalignment provides a predetermined amount of nonperpendicularity between the end wall of the container tray and its first planar surface. The advantage of this slight nonperpendicularity, which will be described in greater detail below, relates to the locking ability of the tray member with respect to the riser of the insert member. In addition, this slight degree of nonperpendicularity also assists the stacking of a plurality of assembled container trays within a larger shipping container.

In certain embodiments of the present invention, the insert member can comprise second and third risers that extend in generally perpendicular association with the second planar surface of the insert member. In addition, one particular embodiment of the present invention comprises a tray member and an insert member that are made of a paper compound, such as corrugated paperboard.

The description of the present invention that is provided immediately above describes one end of the tray member and the insert member. However, it should be understood that both the tray member and the insert member are symmetrical about a centerline in a preferred embodiment of the present invention and can comprise identical ends made in the manner described above.

BRIEF DESCRIPTION OF THE DRAWINGS

The present invention will be more fully and completely understood from a reading of the Description of the Preferred Embodiment in conjunction with the drawings, in which.

DESCRIPTION OF THE PREFERRED EMBODIMENT

Figures 1, 2:
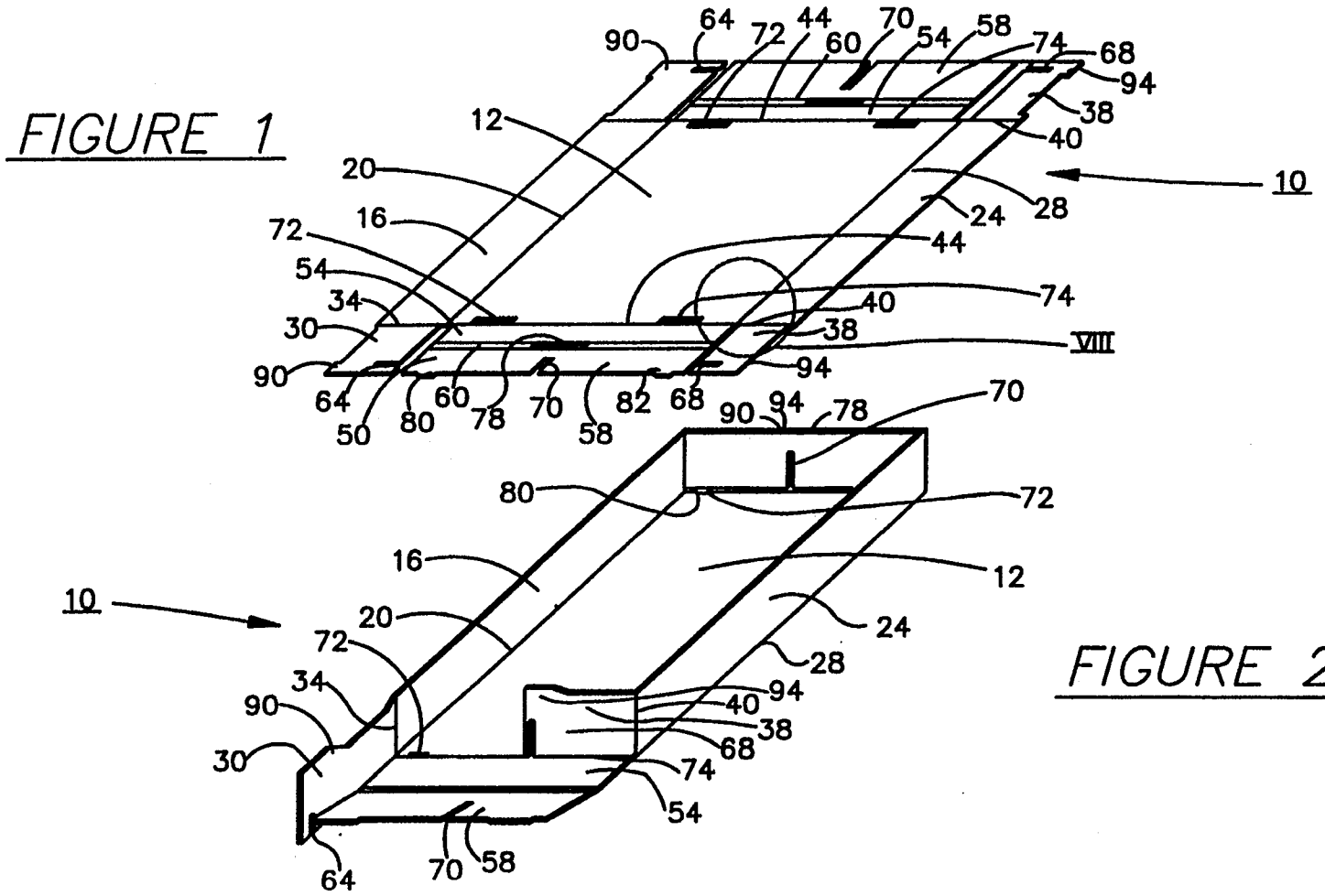
FIG. 1 shows the tray member of the present invention in a flat configuration.
FIG. 2 shows the tray member of the present invention in a partially assembled state.

Throughout the Description of the Preferred Embodiment, like components will be identified by like reference numerals. In addition, since a most preferred embodiment of the present invention comprises a container tray that is symmetrical about a centerline, individual elements of the invention at each end of the container tray will be identified by like reference numerals.

FIG. 1 illustrates the tray member 10 in a flat configuration prior to assembly into its final shape. The tray member 10 has a first planar surface 12. A first side panel 16 is connected to the first planar surface 12 at a first bend line 20. It also comprises a second side panel 24 which is connected to the first planar surface 12 at a second bend line 28. A first extension member 30 is connected to the first side panel 16 at a third bend line 34 and a second extension member 38 is connected to the second side panel 24 at a fourth bend line 40. As will be described in greater detail below in conjunction with FIG. 8, the third and fourth bend lines, 34 and 40, can be arranged in nonaligned association with a fifth bend line 44. The degree of nonalignment is identified in FIG. 8 as angle $\theta$.

With continued reference to FIG. 1, a third extension member 50 comprises a first portion 54 and a second portion 58. The first and second portions, 54 and 58, of the third extension member 50 are connected to each other at a sixth bend line 60. The first portion 54 of the third extension member 50 is connected to the first planar surface 12 at the fifth bend line 44 described above. The first extension member 30 is provided with a first notch 64 and the second extension member 38 is provided with a second notch 68. A third notch 70 is formed in the second portion 58 of the third extension member.

The tray member shown in FIG. 1 is provided with a first slot 72 and a second slot 74 that are formed through the tray member at the fifth bend line 44. In addition, a third slot 78 is formed through the third extension member 50 at the sixth bend line 60. A first tab 80 and a second tab 82 extend from the second portion 58 of the third extension member 50. The first and second slots, 72 and 74, are shaped to receive the first and second tabs, 80 and 82, respectively.

FIG. 2 illustrates the tray member 10 of the present invention with some of its component parts slightly bent to illustrate their ability to be formed in such a way so as to provide the final shape of the tray member. The first and second side panels, 16 and 24, are bendable at the first and second bend lines, 20 and 28, to provide sides which are generally perpendicular to the first planar surface 12. The first and second extension members, 30 and 38, are bendable at the third and fourth bend lines, 34 and 40, to dispose the first and second extension members in generally overlapping association with each other. When these first and second extension members are placed in overlapping association, the first and second notches, 64 and 68, are also aligned with each other. In addition, a third tab 90 and fourth tab 94 extend from the first and second extension members, 30 and 38, respectively. When the first and second extension members are placed in overlapping association with each other, the third and fourth tabs are also placed in alignment with each other.

The third extension member 50 is bendable at the fifth bend line 44 to place the first portion 54 in generally perpendicular association with the first planar surface 12. The second portion 58 can then be bent at the sixth bend line 60 to place the first and second portions in generally parallel and overlapping association with each other. When the third extension member 50 is bent in this matter, along with the fifth and sixth bend lines, the first tab 80 is disposed in the first slot 72 and the second tab 82 is disposed in the second slot 74. The first and second extension members, 30 and 38, are disposed between the first and second portions of the third extension member 50.

In a particularly preferred embodiment of the present invention, the aligned third and fourth tabs, 90 and 94, extend through the third slot 78 to provide a robust and generally rigid end portion of the tray member 10.

The assembly process described above, which comprises a series of bending operations, along preformed bend lines that are scored into the tray member, and the insertion of several tabs into associated slots, is relatively easy to accomplish and can be done in an efficient manner. This ease of assembly is necessary if the design of the tray members is intended to reduce the overall time necessary to provide the container trays.

Figure 3:
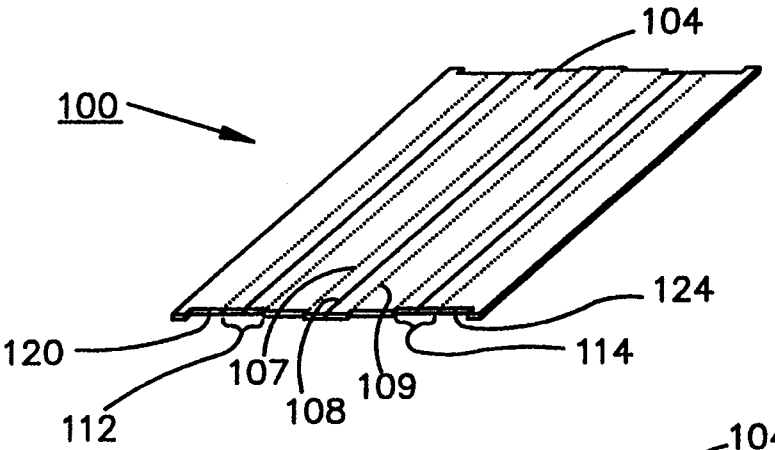
FIG. 3 shows the insert member of the present invention in a flat folded configuration.
Figure 4:
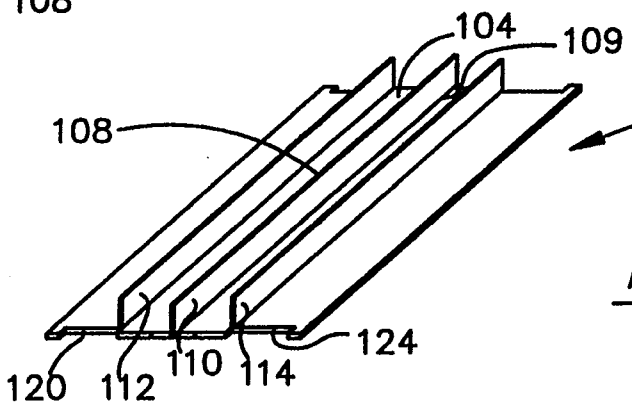
FIG. 4 illustrates the insert member of the present invention in its assembled shape.

FIG. 3 shows an insert member of the present invention in a generally flat structure that is easy to transport from the manufacture of the insert member to the assembler and user of the trays. The insert member 100 has a second planar surface 104. At least one riser is provided in the insert member for the purpose of dividing the second planar surface 104 into a series of compartments, or channels, into which products can be placed during the manufacturing and testing operations and in which the completed products can be contained during shipment to the user of the products. FIGS. 3 and 4 show the bend lines provided to form the risers. The flat structure shown in FIG. 3 is folded to form the assembled structure shown in FIG. 4. A first riser 110 can be formed by bending the second planar surface 104 at seventh 107, eighth 108 and ninth 109 bend lines that are provided by scoring the surface of the second planar surface 104. Additional bend lines permit a second riser 112 and a third riser 114 to be similarly formed. In the configuration shown in FIG. 4, the inwardly directed sides of the second and third risers, 112 and 114, can be glued together to provide a particularly rigid and permanent riser that will extend from the second planar surface 104 in the manner that will be described in greater detail below.

With continued reference to FIG. 3, the end portion of the insert member 100 is provided with a fourth notch 120 and a fifth notch 124. The fourth and fifth notches, 120 and 124, are shaped to receive the first and second tabs, 80 and 82, described above in conjunction with FIG. 1. The association of the insert member 100 and the tray member 10 will be described in greater detail below in conjunction with FIG. 5.

FIG. 4 shows the insert member 100 after the second planar surface 104 is bent along the seventh, eighth and ninth bend lines to form the first riser 100. The second riser 112 and the third riser 114 extend in a generally perpendicular manner from the second planar surface 104 when the configuration shown in FIG. 3 is unfolded and bent as illustrated in FIG. 4. Although the insert member 100 of the present invention can be configured to have a single riser 110, a more preferred embodiment of the present invention comprises a plurality of risers that are arranged in parallel association with each other to define a plurality of channels into which component parts of a product can be stacked and contained during the manufacturing and testing procedures necessary to produce the finished products and, subsequently, contain them during shipment of the tray to a customer.

With continued reference to FIG. 4, it can be seen that the first riser 110 in a preferred embodiment of the present invention extends beyond an imaginary line connecting the ends of the second and third risers, 112 and 114. The purpose of this extension of the end of the first riser 110 will be described in greater detail below in conjunction with FIG. 9.

Figure 5:
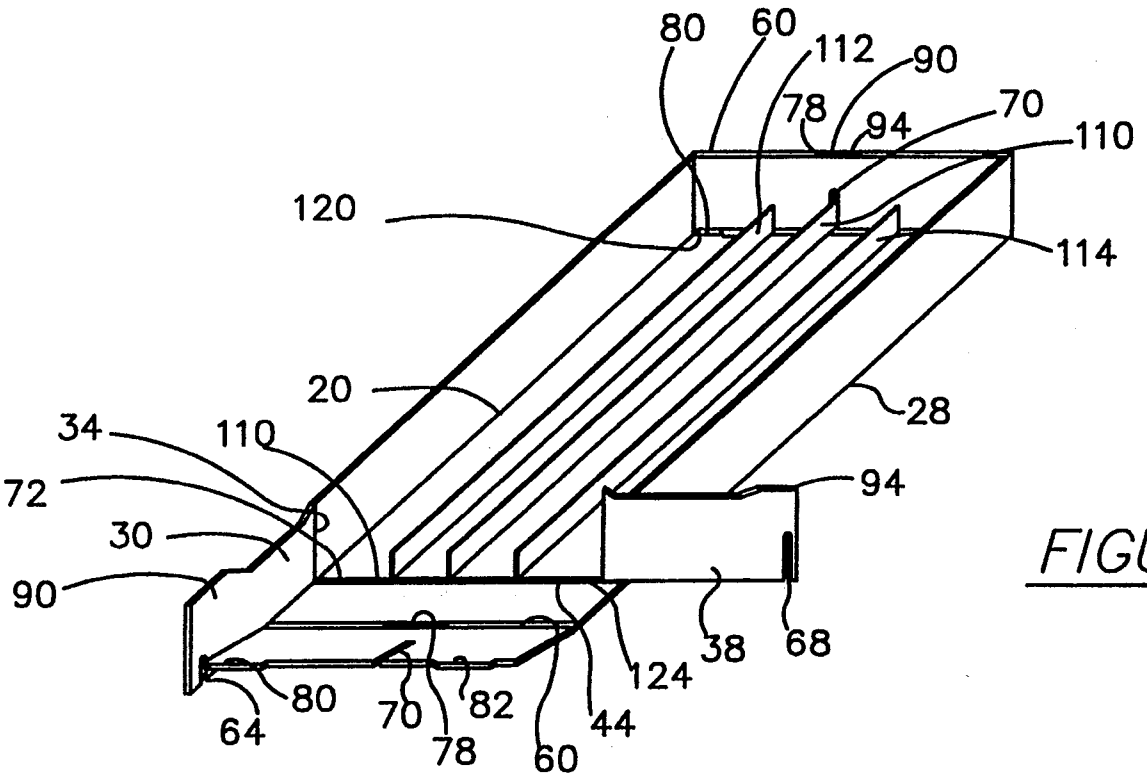
FIG. 5 shows a tray member and an insert member assembled together with the tray member partially disassembled for illustration purposes.

FIG. 5 shows a partially disassembled tray member 10 with an assembled insert member 100 disposed therein. As can be seen in FIG. 5, the fourth and fifth notches, 120 and 124, of the insert member are located at the positions where the first and second slots, 72 and 74, of the tray member are located. As described above, the first and second tabs, 80 and 82, of the second portion 50 are intended to be inserted into the first and second slots and the fourth and fifth notches provide clearance in the insert member 100 where those first and second tabs are located. The first riser 110 is disposed in the opening formed by the first, second and third notches of the tray member. The location of the end portion of the first riser 110 within this opening formed by the first, second and third notches of the tray member locks the insert member into place within the tray member and prevents its accidental removal during the production, testing and shipment of components that are disposed within the channels formed between the first, second and third risers. Although FIG. 5 shows the container tray in a partially disassembled configuration, it should be understood that this partial disassembly of the tray member is intended to show the relative positions of the component parts and the container tray would not typically be in the configuration shown in FIG. 5 after it is initially assembled.

Figure 6:
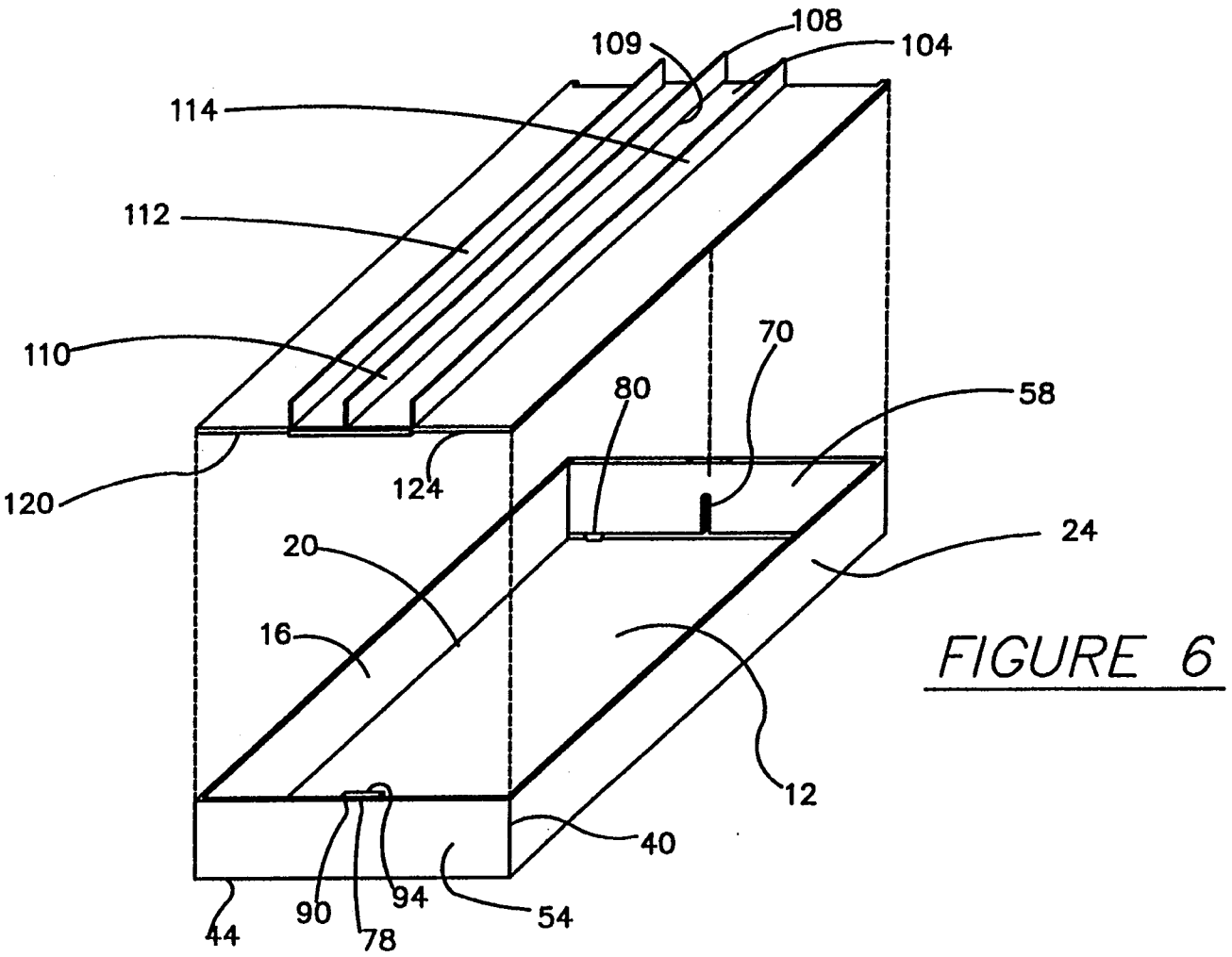
FIG. 6 is an exploded view showing an assembled tray member and an assembled insert member.

FIG. 6 shows the relative positions of the insert member 100 and the tray member 10 as they are assembled together. As can be seen, the first planar surface 12 of the tray member is placed in generally parallel association with the second planar surface 104 of the insert member and the ends of the first riser 110 are placed into the openings formed by the first, second and third notches of the tray member.

Figure 7:
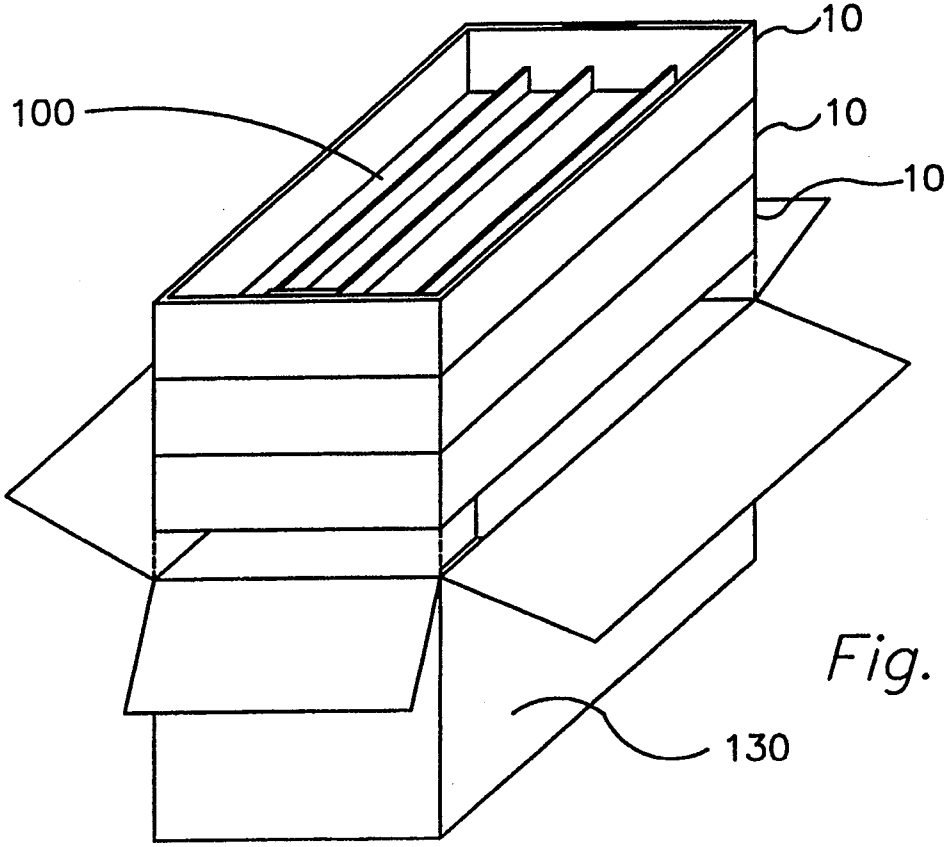
FIG. 7 shows a shipping box with a plurality of container trays.

FIG. 7 shows an exploded view of an outer containment box 130 with a plurality of assembled container trays associated with it. The container trays are shaped to permit easy stacking of one container tray on another container tray. After a plurality of container trays are disposed within an outer box 130, the box can be sealed and the plurality of container trays can be shipped to a customer.

Figure 8:
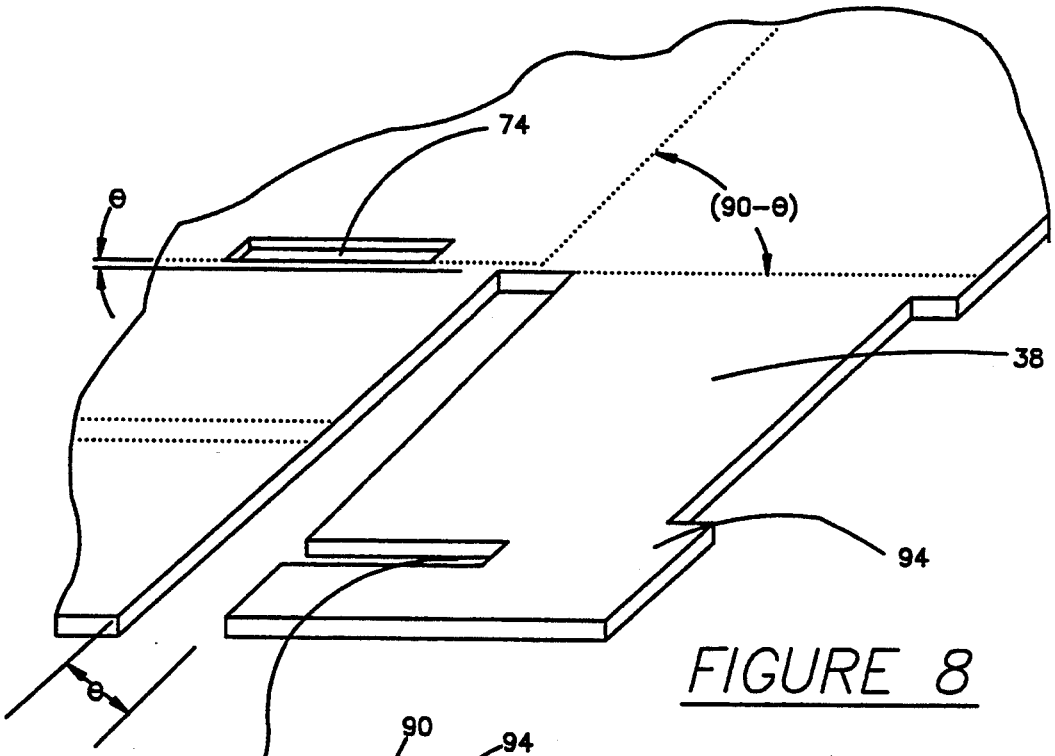
FIG. 8 is a partial view of the tray member shown in FIG. 1.

FIG. 8 illustrates a partial view of the tray member 10 shown in FIG. 1. In the view of FIG. 8, it can be seen that the fourth bend line 40 is arranged in nonaligned association with the fifth bend line 44. This nonalignment is illustrated by angle $\theta$. Although not shown in FIG. 8, the third bend line 34 is similarly arranged in nonaligned association with the fifth bend line 44. The nonalignment illustrated by angle $\theta$ results in a slight nonperpendicularity (e.g. an angle of (90-$\theta$) degrees) between the end wall of the tray member and its first planar surface 12. The advantage of this slight nonperpendicularity is illustrated in FIG. 9.

Figure 9:
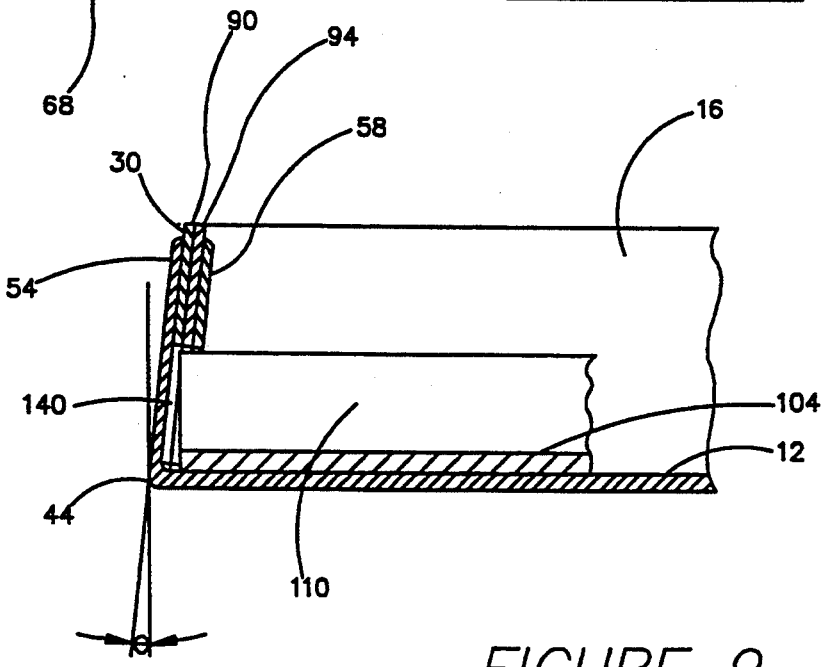
FIG. 9 is a section view of the end portion of a container tray made in accordance with the present invention.

FIG. 9 is a sectional view taken along a centerline that extends through the third slot 78 and the third notch 70 at one end of the tray member. In the assembled configuration shown in FIG. 9, the first portion 54 of the third extension member 50 is bent along the fifth bend line 44 to extend in a generally perpendicular association with the first planar surface 12. However, although this relationship is described as being generally perpendicular, angle $\theta$ shows the slight degree of nonperpendicularity which is intentionally provided by the nonalignment of the fourth bend line 40 and the fifth bend line 44. The second portion 58 of the third extension member 50 is shown in generally parallel association with the first portion 54. Between the first and second portions of the third extension member, the first extension member 30 and second extension member 38 are disposed in overlapping relationship with each other. An opening 140 results from the alignment of the first notch 64, the second notch 68 and the third notch 70 as described in detail above. This opening 140 is shaped to receive the end portion of the first riser 110 as shown.

With continued reference to FIG. 9, it can be seen that the slight degree of nonperpendicularity between the end of the tray member and its first planar surface 12 provides a locking function that captures and maintains the end of the first riser 110 within the opening 140. Once the riser 110 is disposed in the opening 140 by gently pushing the end walls of the tray member apart during the assembly of the insert member 100 into the tray member 10, the nonperpendicularity locks the insert member into place against the first planar surface 12.

With continued reference to FIG. 9, it can be seen that the slight nonperpendicularity represented by angle $\theta$ also serves to provide another important function of the present invention. This slight nonperpendicularity results in the upper edge of the end wall, where the third and fourth tabs, 90 and 94, are displaced from the outer edge of the first planar surface at the fifth bend line 44. Because of this difference in dimension resulting from the slight nonperpendicularity described above, a similarly configured container tray can be stacked on top of the tray shown in FIG. 9 without resulting in the upper tray dropping down onto the components stored in the channels between the risers. When a plurality of container trays are disposed within an outer shipping box, this function is enhanced and a plurality of the container trays can be stacked easily and maintained in parallel association with each other for shipment to a customer.

As described above, the present invention provides a tray member 10 that is robust and able to withstand the rigors of the manufacturing and shipping processes. The arrangement of the third extension member 50 in conjunction with the first and second extension members, 30 and 38, results in an end portion of the tray member that is extremely difficult to pull apart. Because of the configuration of the third tab 90 and fourth tab 94 which are disposed within the third slot 78, the end structure of the tray member provides a very strong resistance to movement of the first and second side panels, 16 and 24, away from each other. Therefore, the assembled tray member 10 is able to withstand significant abuse during movement from one work station to another, when the trays are shipped and when the container trays are removed from their outer shipping box by a customer. The relative geometry of the components of both the tray member 10 and the insert member 100 also serves to prevent inadvertent removal of the insert member 100 from the tray member 10.

Although the present invention has been described in considerable detail and illustrated with particular specificity, it should be understood that slight changes to the geometry of the component parts are within its scope. In addition, although the tray member and insert member are intended to be joined to each other in the manner described above, individual tray members and insert members are also within the scope of the present invention.

The embodiments of the invention in which an exclusive property or right is claimed are defined as follows:

1. A container tray, comprising:

a tray member having a first planar surface;

a first side panel connected to said first planar surface at a first bend line; a second side panel connected to said first planar surface at a second bend line, said first planar surface being disposed between said first and second side panels;

a first extension member connected to said first side panel at a third bend line;

a second extension member connected to said second side panel at a fourth bend line;

a third extension member connected to said first planar surface at a fifth bend line, said third extension member comprising a first portion and a second portion, said second portion being connected to said first portion at a sixth bend line and said first portion being connected to said planar surface at said fifth bend line;

a first tab and a second tab extending in a common direction from said second portion of said third extension member, said second portion of said third extension member being disposed between said first and second tabs and said sixth bend line;

a first slot and a second slot extending through said fifth bend line;

a first notch formed in said first extension member;

a second notch formed in said second extension member;

a third notch formed in said second portion of said third extension;

said first side panel being bendable at said first bend line into generally perpendicular association with said first planar surface, said second side panel being bendable at said second bend line into generally perpendicular association with said first planar surface, said first extension member and said second extension member being bendable at said third and fourth bend lines, respectively, into overlapping association with each other, said third extension member being bendable at said fifth bend line into generally perpendicular association with said first planar surface, said second portion of said third extension member being bendable at said sixth bend line into overlapping association with said first portion of said third extension member with said first and second extension members disposed therebetween and with said first and second notches aligned with each other, said first slot being shaped to receive said first tab therein, said second slot being shaped to receive said second tab therein;

an insert member having a second planar surface;

a first riser extending in generally perpendicular association from said second planar surface, said first riser being formed by bending said insert member at seventh, eighth and ninth bend lines, said third notch being shaped to receive an end of said first riser therein;

a fourth notch formed in said second planar surface, said fourth notch being shaped to receive said first tab therein; and a fifth notch formed in said second planar surface, said fifth notch being shaped to receive said second tab therein, said insert member being disposable within said tray member with said first planar surface being disposed in parallel association with said second planar surface.

2. The container tray of claim 1, further comprising:

a third slot extending through said sixth bend line;

a third tab extending from said first extension member; and a fourth tab extending from said second extension member, said third and fourth tabs being disposable in overlapping association with each other when said first and second extension members are disposed in overlapping association with each other, said third slot being shaped to receive said third and fourth tabs therein.

3. The container tray of claim 1, wherein:

said third and fourth bend lines are disposed in non-aligned association with said fifth bend line.

4. The container tray of claim 1, wherein:

said insert member comprises second and third risers extending in generally perpendicular association with said second planar surface.

5. The container tray of claim 1, wherein:

said tray member and said insert member are made of a paper compound.

6. A container tray, comprising:

a tray member having a first end and a second end and a first planar surface disposed therebetween, said first and second ends each comprising;

a first side panel connected to said first planar surface at a first bend line, a second side panel connected to said first planar surface at a second bend line, said first planar surface being disposed between said first and second side panels, a first extension member connected to said first side panel at a third bend line, a second extension member connected to said second side panel at a fourth bend line, a third extension member connected to said first planar surface at a fifth bend line, said third extension member comprising a first portion and a second portion, said second portion being connected to said first portion at a sixth bend line and said first portion being connected to said planar surface at said fifth bend line, a first tab and a second tab extending in a common direction from said second portion of said third extension, said second portion of said third extension member being disposed between said first and second tabs and said sixth bend line, a first slot and a second slot extending through said fifth bend line, a third slot extending through said sixth bend line, a first notch formed in said first extension, a second notch formed in said second extension, a third notch formed in said second portion of said third extension, said first side panel being bendable at said first bend line into generally perpendicular association with said first planar surface, said second side panel being bendable at said second bend line into generally perpendicular association with said first planar surface, said first extension member and said second extension member being bendable at said third and fourth bend lines, respectively, into overlapping association with each other, said third extension member being bendable at said fifth bend line into generally perpendicular association with said first planar surface, said second portion of said third extension member being bendable at said sixth bend line into overlapping association with said first portion of said third extension member with said first and second extension members disposed therebetween and with said first and second notches aligned with each other, said first slot being shaped to receive said first tab therein, said second slot being shaped to receive said second tab therein; and an insert member having a first end and a second end and a second planar surface, said first and second ends each comprising; a first riser extending in generally perpendicular association from said second planar surface, said first riser being formed by bending said insert member at seventh, eighth and ninth bend lines, said third notch being shaped to receive an end of said first riser therein, a fourth notch formed in said second planar surface, said fourth notch being shaped to receive said first tab therein and a fifth notch formed in said second planar surface, said fifth notch being shaped to receive said second tab therein, said insert member being disposable within said tray member with said first planar surface being disposed in parallel association with said second planar surface.

7. The container tray of claim 6, further comprising:

a third tab extending from said first extension member; and a fourth tab extending from said second extension member, said third and fourth tabs being disposable in overlapping association with each other when said first and second extension members are disposed in overlapping association with each other, said third slot being shaped to receive said third and fourth tabs therein.

8. The container tray of claim 7, wherein:

said third and fourth bend lines are disposed in non-aligned association with said fifth bend line.

9. The container tray of claim 8, wherein:

said insert member comprises second and third risers extending in generally perpendicular association with said second planar surface.

10. The container tray of claim 9, wherein:

said tray member and said insert member are made of a paper compound.

11. A container tray, comprising:

a tray member having a first planar surface;

a first side panel connected to said first planar surface at a first bend line;

a second side panel connected to said first planar surface at a second bend line, said first planar surface being disposed between said first and second side panels;

a first extension member connected to said first side panel at a third bend line;

a second extension member connected to said second side panel at a fourth bend line;

a third extension member connected to said first planar surface at a fifth bend line, said third extension member comprising a first portion and a second portion, said second portion being connected to said first portion at a sixth bend line and said first portion being connected to said planar surface at said fifth bend line;

a first tab and a second tab extending in a common direction from said second portion of said third extension, said second portion of said third extension member being disposed between said first and second tabs and said sixth bend line;

a first slot and a second slot extending through said fifth bend line;

a third slot extending through said sixth bend line;

a first notch formed in said first extension;

a second notch formed in said second extension;

a third notch formed in said second portion of said third extension;

said first side panel being bendable at said first bend line into generally perpendicular association with said first planar surface, said second side panel being bendable at said second bend line into generally perpendicular association with said first planar surface, said first extension member and said second extension member being bendable at said third and fourth bend lines, respectively, into overlapping association with each other, said third extension member being bendable at said fifth bend line into generally perpendicular association with said first planar surface, said second portion of said third extension member being bendable at said sixth bend line into overlapping association with said first portion of said third extension member with said first and second extension members disposed therebetween and with said first and second notches aligned with each other, said first slot being shaped to receive said first tab therein, said second slot being shaped to receive said second tab therein;

an insert member having a second planar surface;

a first riser extending in generally perpendicular association from said second planar surface, said first riser being formed by bending said insert member at seventh, eighth and ninth bend lines, said third notch being shaped to receive an end of said first riser therein;

a fourth notch formed in said second planar surface, said fourth notch being shaped to receive said first tab therein;

a fifth notch formed in said second planar surface, said fifth notch being shaped to receive said second tab therein, said insert member being disposable within said tray member with said first planar surface being disposed in parallel association with said second planar surface;

a third tab extending from said first extension member; and a fourth tab extending from said second extension member, said third and fourth tabs being disposable in overlapping association with each other when said first and second extension members are disposed in overlapping association with each other, said third slot being shaped to receive said third and fourth tabs therein.

12. The container tray of claim 11, wherein:

said third and fourth bend lines are disposed in non-aligned association with said fifth bend line.

13. The container tray of claim 11, wherein:

said insert member comprises second and third risers extending in generally perpendicular association with said second planar surface.

14. The container tray of claim 11, wherein:

said tray member and said insert member are made of a paper compound.

* * * * *